US008791934B2

(12) United States Patent
Boom et al.

(10) Patent No.: US 8,791,934 B2
(45) Date of Patent: Jul. 29, 2014

(54) DRIVING OF ELECTRO-OPTIC DISPLAYS

(75) Inventors: Robert Gerardus Hendrik Boom, Venlo (NL); Roy Van Dijk, Eindhoven (NL); Henricus Petronella Maria Derckx, Weert (NL)

(73) Assignee: Liquavista B.V., Eindhoven (NL)

( * ) Notice: Subject to any disclaimer, the term of this patent is extended or adjusted under 35 U.S.C. 154(b) by 819 days.

(21) Appl. No.: 12/515,121

(22) PCT Filed: Nov. 15, 2007

(86) PCT No.: PCT/EP2007/062428
§ 371 (c)(1),
(2), (4) Date: Dec. 14, 2009

(87) PCT Pub. No.: WO2008/059039
PCT Pub. Date: May 22, 2008

(65) Prior Publication Data

US 2010/0079434 A1 Apr. 1, 2010

(30) Foreign Application Priority Data

Nov. 16, 2006 (GB) ..... 0622900.9

(51) Int. Cl.
*G09G 5/00* (2006.01)
*G09G 3/34* (2006.01)

(52) U.S. Cl.
USPC ..... 345/211; 345/107; 359/296

(58) Field of Classification Search
USPC ..... 345/87–108, 204, 690, 208–211; 359/296
See application file for complete search history.

(56) References Cited

U.S. PATENT DOCUMENTS

| | | | | |
|---|---|---|---|---|
| 6,462,728 | B1 | 10/2002 | Janssen et al. | |
| 6,603,457 | B1 * | 8/2003 | Nakanishi | 345/107 |
| 6,961,257 | B2 | 11/2005 | Garverick et al. | |
| 7,030,850 | B2 * | 4/2006 | Morita | 345/98 |
| 2007/0002008 | A1 * | 1/2007 | Tam | 345/107 |

FOREIGN PATENT DOCUMENTS

| | | | |
|---|---|---|---|
| EP | 1 184 714 | | 3/2002 |
| EP | 1 184 714 | A2 | 3/2002 |
| TW | 200627345 | A | 8/2006 |
| TW | 200636660 | A | 10/2006 |

(Continued)

OTHER PUBLICATIONS

International Search Report dated Mar. 20, 2008 from Application No. PCT/EP2007/062428, International Filing Date: Nov. 15, 2007, 4 pages.

(Continued)

*Primary Examiner* — Stephen Sherman
(74) *Attorney, Agent, or Firm* — BainwoodHuang

(57) ABSTRACT

The invention relates to a method of driving of an electro-optic display having image regions. Each image region has: a first driving state in which a zero voltage, substantially equal to zero, is applied across the image region; and a second driving state in which a non-zero voltage, substantially different from the zero voltage, is applied across the image region. The method of the invention comprises applying: a common voltage signal to a plurality of the image regions; and an actuating voltage signal to one or more selected ones of the plurality of image regions. The method comprises varying both the common voltage signal and the actuating voltage signal when switching the selected regions between the first driving state and the second driving state. The invention further relates to electro-optic display apparatus having image regions and comprising driving circuitry adapted to perform the method of the invention.

23 Claims, 4 Drawing Sheets

(56) References Cited

FOREIGN PATENT DOCUMENTS

| | | | |
|---|---|---|---|
| WO | 03/071346 | A1 | 8/2003 |
| WO | 2005/034074 | A1 | 4/2005 |
| WO | 2005/036517 | A1 | 4/2005 |
| WO | WO 2005/034074 | | 4/2005 |
| WO | 2005/098797 | A2 | 10/2005 |
| WO | WO 2005/098797 | | 10/2005 |
| WO | 2006/030384 | A2 | 3/2006 |
| WO | WO 2006/030384 | | 3/2006 |
| WO | 2006/061739 | A2 | 6/2006 |
| WO | WO 2006/061739 | | 6/2006 |

OTHER PUBLICATIONS

United Kingdom Search Report dated Jun. 26, 2007 from Application No. GB 0622900.9, 1 page.

International Search Report for PCT/EP2007/062428 mailed Mar. 20, 2008.

Written Opinion of the International Searching Authority for PCT/EP2007/062428 mailed Mar. 20, 2008.

Translation of Search Report issued by Taiwanese Patent Office in related application No. TW 096143334, Jul. 11, 2013.

* cited by examiner

DRIVING OF ELECTRO-OPTIC DISPLAYS

FIELD OF THE INVENTION

This invention relates to a method of driving of electro-optic displays, and electro-optic display apparatus.

BACKGROUND OF THE INVENTION

Various different types of electro-optic display are known, including liquid crystal displays, electrophoretic displays, electrochromic displays, etc. A recently developed type of electro-optic display is an electrowetting display, as described amongst others in international patent applications WO 2003/071346 and WO 2005/098797.

For explanatory purposes, a prior art drive circuitry arrangement and its driving scheme is illustrated in FIGS. 7, 8 and 9. Referring to FIG. 7, in the prior art arrangement, a common voltage signal is held at a voltage level Vcom, whilst an actuating voltage signal Vout is modulated by selectively actuating switches S1 and S2—this may for example be carried out according to the switching scheme illustrated in FIG. 9. This results in the output waveform shown in FIG. 8. A disadvantage of the switching scheme shown is that the voltage step required, and the associated rate of change of voltage, is relatively high.

It would be desirable to provide an improved method of driving an electro-optic apparatus. In particular, but not exclusively, it would be desirable to provide an improved method of driving an electrowetting display.

SUMMARY OF THE INVENTION

In accordance with one aspect of the present invention, there is provided a method of driving an electro-optic display, the display having image regions, each image region having:

a first driving state in which a zero voltage, which zero voltage is substantially equal to zero, is applied across the image region; and a second driving state in which a non-zero voltage, which non-zero voltage is substantially different from said zero voltage, is applied across the image region, the method comprising applying:

a common voltage signal to a plurality of said image regions; and an actuating voltage signal to one or more selected ones of said plurality of image regions, wherein said method comprises varying both said common voltage signal and said actuating voltage signal when switching said selected regions between said first driving state and said second driving state.

In accordance with a further aspect of the present invention, there is provided electro-optic display apparatus, the display apparatus having image regions, each image region having:

a first driving state in which a zero voltage, which zero voltage is substantially equal to zero, is applied across the image region; and a second driving state in which a non-zero voltage, which non-zero voltage is substantially different from said zero voltage, is applied across the image region, the display apparatus comprising driving circuitry adapted to apply:

a common voltage signal to a plurality of said image regions; and an actuating voltage signal to one or more selected ones of said plurality of image regions, wherein said driving circuitry is adapted to vary both said common voltage signal and said actuating voltage signal when switching said selected regions between said first driving state and said second driving state.

Advantages of the invention include at least one of lower power requirements, faster response speeds and/or lower electromagnetic interference (EMI) levels in electro-optic displays.

Features and advantages of the invention will become apparent from the following description of preferred embodiments of the invention, given by way of example only, which is made with reference to the accompanying drawings.

DETAILED DESCRIPTION OF THE INVENTION

Figure 1:
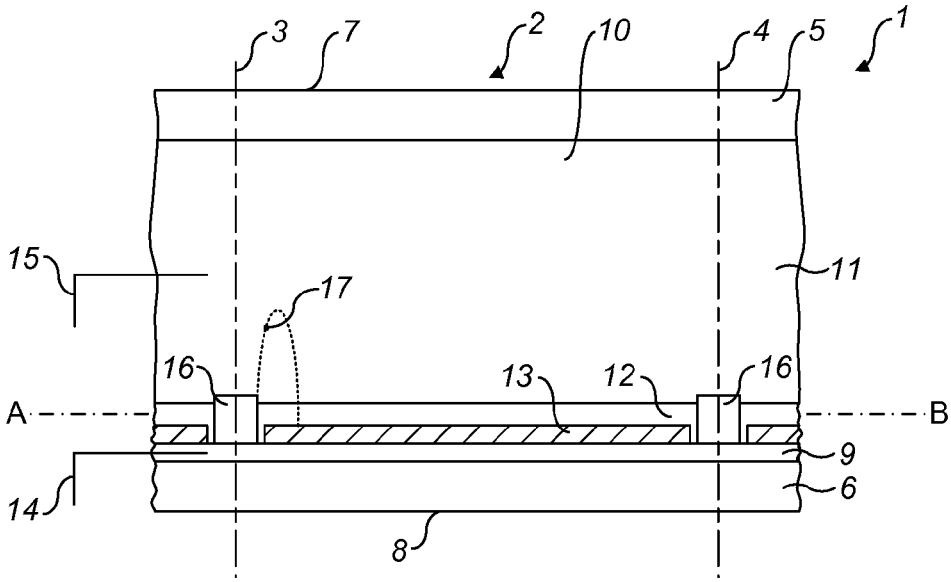
FIG. 1 shows a diagrammatic cross-section of a part of an embodiment of electro-optic display apparatus according to the invention.

FIG. 1 shows a diagrammatic cross-section of an embodiment of an electrowetting display apparatus 1 according to the invention. The display apparatus includes a plurality of electrowetting elements 2, one of which is shown in the Figure. The lateral extent of the element is indicated in the Figure by the two dashed lines 3, 4. The electrowetting elements comprise a first support plate 5 and a second support plate 6. The support plates may be separate parts of each electrowetting element, but the support plates are preferably shared in common by the plurality of electrowetting elements. The support plates may be made for instance of glass or polymer and may be rigid or flexible.

The display apparatus has a viewing side 7 on which an image formed by the display apparatus can be viewed and a rear side 8. If the rear side 8 is made of a transparent material, as in the case of a glass plate, it may alternatively, or in addition, be used as a viewing side. The first support plate 5 faces the viewing side; the second support plate 6 faces the rear side 8. The display is, in this embodiment, a segmented display type, in which the image portions are defined by segments which can be switched simultaneously. The image is thus built up of segments. Each segment includes a number of adjacent electrowetting elements 2.

A space 10 between the support plates is filled with two liquids: a first liquid 11 and a second liquid 12. The first liquid is immiscible with the second liquid. The first liquid is electrically conductive or polar, and may be water or a salt solution such as a solution of potassium chloride in a mixture of water and ethyl alcohol. The first liquid is preferably transparent. The second liquid is electrically non-conductive and may for instance be an alkane like hexadecane or (silicone) oil. A hydrophobic layer 13 is arranged on the support plate 6, creating an electrowetting surface area facing the space 10. The layer may be an uninterrupted layer extending over a plurality of electrowetting elements 2 or it may be an interrupted layer, each part extending only over one electrowetting element 2. The layer may be for instance an amorphous fluoropolymer layer such as AF1600 or other low surface energy polymers such as Parylene. The hydrophobic character causes the second liquid to adhere preferentially to the support plate 6 since the second liquid has a higher wettability with respect to the surface of the hydrophobic layer 13 than it has with respect to the first liquid. Wettability relates to the relative affinity of a fluid for the surface of a solid. Wettability increases with increasing affinity, and it can be measured by the contact angle formed between the fluid and the solid. This increases from relative non-wettability at an angle less than 90° to complete wettability when the contact angle is 180°, in which case the liquid forms a film on the surface of the solid.

Each segment is defined by a segment electrode 9 arranged on the second support plate 6. The segment electrode 9 is separated from the liquids by an insulator, which may be the hydrophobic layer 13. In general, the segment electrode 9 will be one of a number of separate electrodes arranged separately on the second support plate 6, each of which can be of any desired shape or form. Each segment electrode will define an image region which overlaps a plurality of electrowetting elements which will all be switched simultaneously by at least the segment electrode. The segment electrode 9 is supplied with voltage signals by a signal line 14. A second signal line 15 is connected to an electrode which is in contact with the conductive first liquid 11. This electrode is common to all segments, since they are fluidly interconnected by and share the first liquid, uninterrupted by walls. The segment electrodes 9 on the support plate 6 each are connected to driving circuitry on the support plate by a matrix of printed wiring.

The lateral extent of the second liquid 12 is constrained to one electrowetting element by walls 16 that follow the cross-section of the electrowetting element in the plane A-B. Further details of the electrowetting elements of the display and their manufacture are disclosed amongst others in international patent application WO 2005/098797.

The second liquid absorbs at least a part of the optical spectrum. The liquid may be transmissive for a part of the optical spectrum, forming a colour filter. For this purpose the liquid may be coloured by addition of pigment particles or dye. Alternatively, the liquid may be black, i.e. absorb substantially all parts of the optical spectrum. The surface of the hydrophobic layer may be white, or a relatively light colour.

When a non-zero voltage is applied between the signal lines 14 and 15, electrostatic forces will move the first liquid 11 towards the segment electrode 9, thereby repelling the second liquid 12 from the area of the hydrophobic layer 13 to the walls 16 surrounding the area of the hydrophobic layer, to a drop-like form as schematically indicated by a dashed line 17. This action uncovers the second liquid from the surface of the hydrophobic layer 13 of the electrowetting element. When the voltage across the element is returned to zero, or a value near to zero, the second liquid flows back to cover the hydrophobic layer 13. In this way the second liquid forms an electrically controllable optical switch in each electrowetting element.

Figure 2:
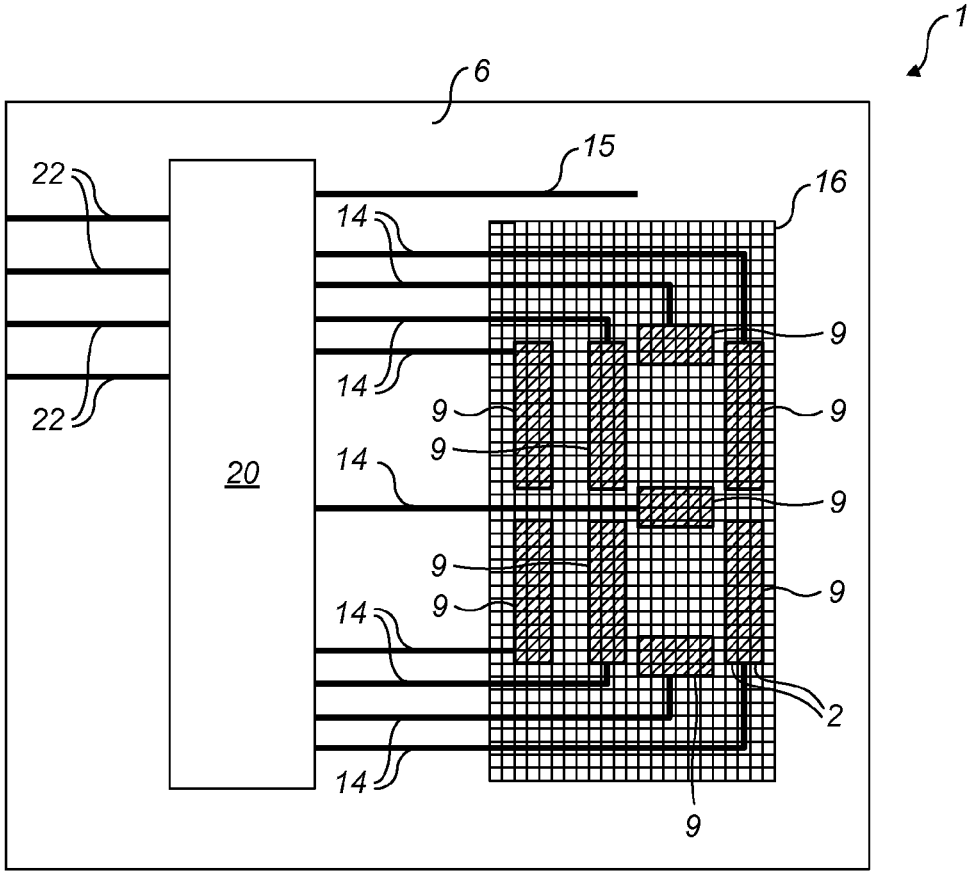
FIG. 2 shows a diagrammatic planar view of a part of an embodiment of electro-optic display apparatus according to the invention.

FIG. 2 shows a diagrammatic planar view of an embodiment of an electrowetting display apparatus 1 according to the invention.

The electrowetting display apparatus is in this embodiment a segmented display in the form of a numeric display which is defined by a number of different segments. The segments can be selectively actuated in order to display a number from 0 to 19. The segments are defined by 9 separate segment electrodes 9 formed on the second support plate 6. Each segment electrode is indicated by cross-hatchings in FIG. 2. The display apparatus also includes a raster grid of electrowetting element walls 16 forming square electrowetting elements which cover at least the area of the segment electrodes 9 (only some of the electrowetting elements 2 are labelled in FIG. 2 for clarity). The second liquid 12 is present in at least the electrowetting elements which overlap with the segment electrodes, to form operable electrowetting elements. Those electrowetting elements which are outside the segment electrodes 9 are non-operable. They may also include the second fluid 12, or the second fluid 12 may be missing from the non-operable elements.

The driving circuitry of the display apparatus 1 includes a driver controller 20 in the form of an integrated circuit adhered to the support plate 6. The driver controller 20 includes control logic and switching logic, and is connected to the display by means of segment signal lines 14 and common voltage signal line 15. Each segment electrode signal line 14 connects an output from the driver controller 20 to a different segment electrode 9, respectively. Also included are a set of input data lines 22, whereby the driver controller can be instructed with data so as to determine which segments should be in a selected state and which segments should be in a non-selected state at any time.

By selectively actuating certain of the segment electrodes with an actuating voltage signal, the electrowetting elements which overlap with the selected segment electrodes are driven to an open state, in which the second liquid 12 is removed from the surface of the support plate 6, whilst other non-selected electrodes are driven with a non-electrowetting voltage signal which is equal to, or at least substantially equal to, the common voltage signal applied to the common voltage signal line 15.

Figure 3:
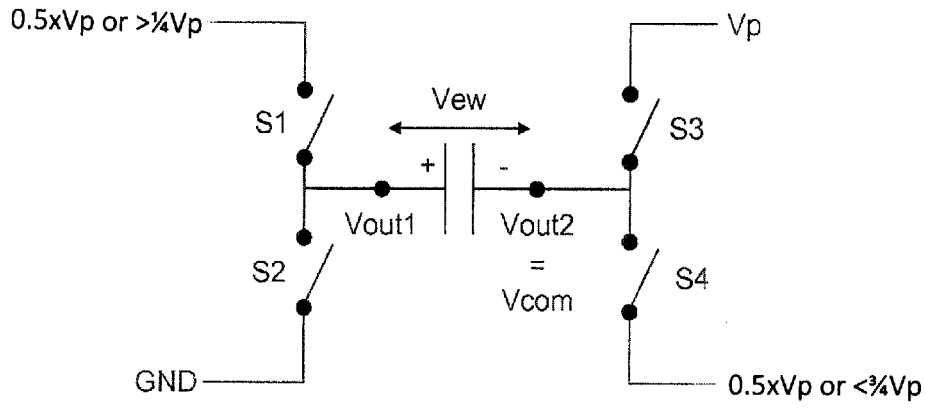
FIG. 3 shows a driver circuitry switching arrangement according to an embodiment of the invention.

FIG. 3 illustrates a switching arrangement implemented in the driver controller 20 for each segment 9 of the electro-optic display apparatus. For each of the signal lines 14 (and thus in respect of each segment 9), a set of switches S1 and S2 is implemented as a driver stage in the driver controller 20; the controller 20 also includes a set of switches S3 and S4 for the common voltage signal line 15. The switches S1 and S2 are operated selectively to generate an actuating voltage signal Vout1, whilst the switches S3 and S4 are selectively actuated in order to generate a common voltage signal Vout2, also referred to as Vcom. For any given segment 9, both the actuating voltage signal Vout1 and the common voltage signal Vout2 are modulated, depending on the selection of switches currently applied for the segment. As a result, a voltage Vew is applied across each segment; that is to say each electrowetting element within a particular segment receives the voltage Vew.

Figure 4:
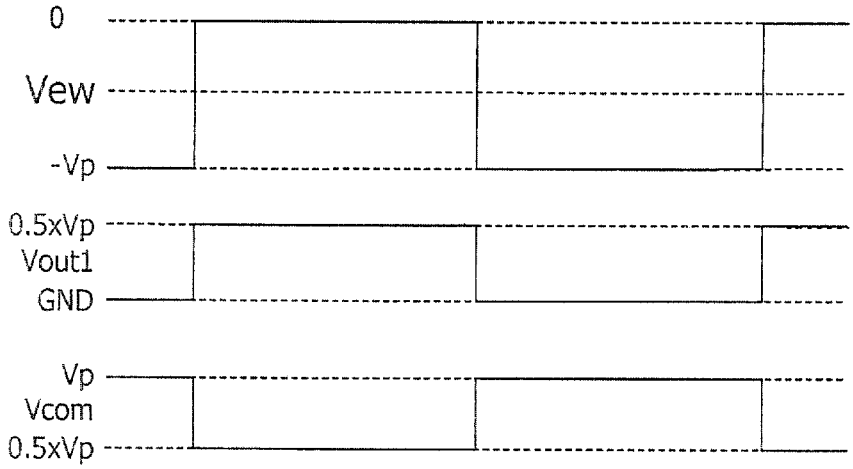
FIG. 4 shows voltage signals generated using the circuitry of FIG. 3.

FIG. 4 illustrates the variation of the actuating voltage signal Vout1 and the common voltage signal Vcom when driving a particular segment. FIG. 4 illustrates a driving scheme required to drive the selected segment or segments alternately between a display state, when the voltage Vew across the electrowetting element within the segment is a non-zero voltage (−Vp), and a non-display state in which the voltage Vew across the electrowetting elements of the segment is at a zero voltage level.

In this driving scheme, the required variation of the voltage across the electrowetting elements is achieved by switching the actuating voltage signal Vout1 between a level which is half of the non-zero voltage level (0.5×Vp) and ground (GND) whilst simultaneously switching the common voltage signal Vcom between a level equal to the magnitude of the non-zero voltage (Vp) and a level equal to half of the magnitude of the non-zero voltage (0.5×Vp). The respective variations of the actuating voltage signal Vout1 and the common voltage signal Vcom are of different polarities, as can be seen in FIG. 4. Thus, in combination the respective voltage signals applied to the respective different electrodes, when combined, switch a selected segment from a first driving state, in which a zero voltage, i.e. a voltage which is substantially equal to zero, is applied across the segment, and a second driving state, in which a non-zero voltage, which is substantially different from said zero voltage, is applied across the segment.

Figure 5:
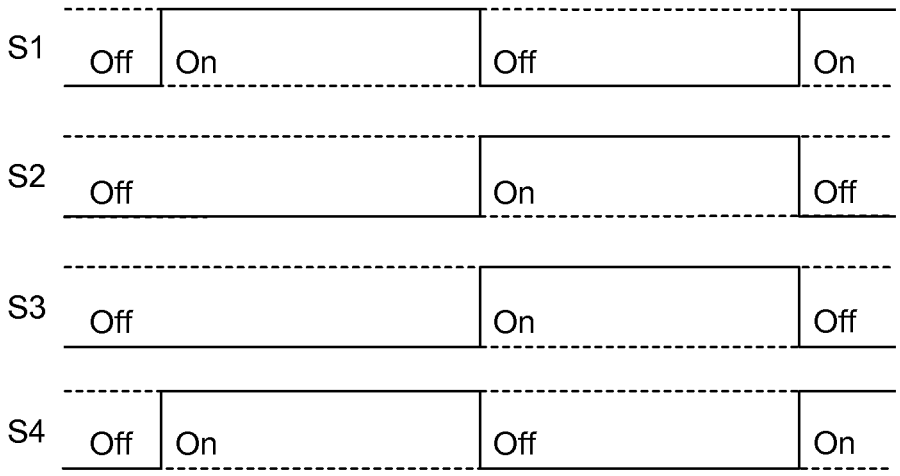
FIG. 5 shows switch control signals for the circuitry of FIG. 3.

FIG. 5 illustrates the switching scheme which is used to generate the voltage signals illustrated in FIG. 4; as can be seen, the actuating voltage signal Vout1 is generated by alternately switching S1 and S2 on and off, S1 being on whilst S2 is off and vice versa. Meanwhile, the common voltage signal Vcom is generated by alternately switching S3 and S4 on and off, S3 being off whilst S4 is on and vice versa.

In the case of electrowetting displays, the voltage step required for switching an electrowetting element between a closed state and an open state is typically above 20 volts, and can be in the region of 30 volts. By reducing the voltage step at each switch, in accordance with embodiments of the invention, a more practical and less costly driver controller circuit can be utilised. In the current system, an example of a suitable display driver controller is the SSD1622 driver controller produced by Solomon Systech Limited of Hong Kong.

Figure 6:
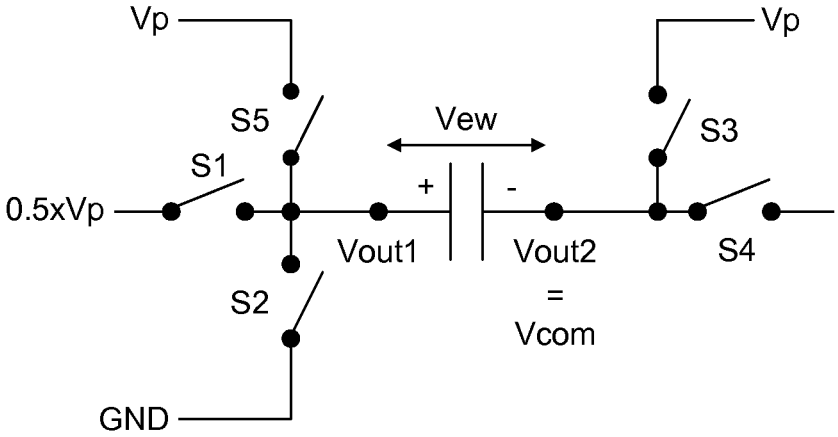
FIG. 6 shows an alternative driver circuitry switching arrangement according to an embodiment of the invention.
Figure 7:
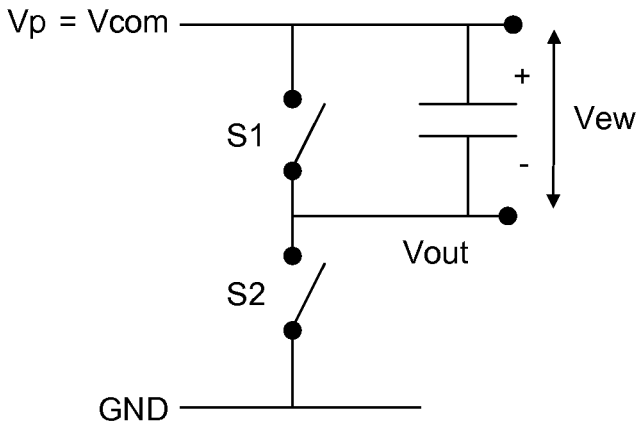
FIG. 7 PRIOR ART
FIG. 7 shows a prior art driver circuitry switching arrangement.
Figure 8:
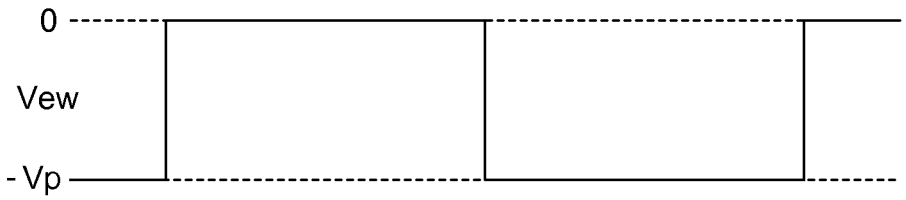
FIG. 8 PRIOR ART
FIG. 8 shows voltage signals generated using the circuitry of FIG. 7.
Figure 9:
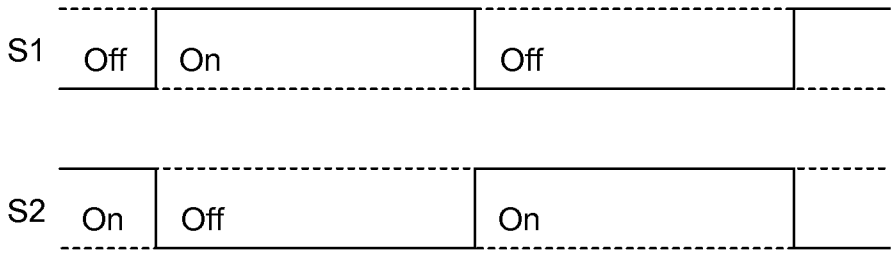
FIG. 9 PRIOR ART
FIG. 9 shows switch control signals for the circuitry of FIG. 7.

FIG. 6 illustrates a further embodiment of the invention in which each driver stage includes a variation on the arrangement illustrated in FIG. 3; this embodiment is particularly suited for driving non-selected segments in a non-display state when the common voltage signal is being modulated. In this further embodiment, the driver stage for a segment includes one further switch which is supplied with a further voltage level such that the voltage across each segment may be driven according to a non-actuating voltage signal. This enables non-selected segments to be driven in a non-display state even when the common voltage signal is being modulated. In this case, when the common voltage signal Vcom is switched between a level equal to the magnitude of the non-zero voltage (Vp) and a level equal to half of the magnitude of the non-zero voltage (0.5×Vp), the non-selected segment may be switched in correspondence with the common voltage signal Vcom by operating the additional switch S5 in combination with the switch S1 according to the scheme shown for switches S3 and S4 respectively in FIG. 5.

In an alternative embodiment to that shown in FIG. 6, the common voltage signal Vcom can have an additional switch to GND similar to the switch S2 on the segment side of the driver stage. This provides a variety of additional modulation schemes which provide a toggle between a positive and negative drive of the load.

In the above embodiments, the voltage steps taken by the actuating voltage signal and the common voltage signal are each one half of the total voltage step across the image region. This is a preferred set of voltage levels. However, other non-symmetrical voltage levels are envisaged. For example, the voltage steps taken by the actuating voltage signal and the common voltage signal may be one quarter and three quarters of the total voltage step across the image region.

International patent application WO 2003/071346 discloses measures that allow the second liquid to cover the area of the electrowetting element only partially, thereby realizing so-called grey values. Such a scheme may also be used in embodiments of the present invention. The grey values may be obtained by applying a pulse-width modulated voltage signal to each of the electrowetting elements which are selected to be in a common grey value display state.

The above embodiments are to be understood as illustrative examples of the invention. Further embodiments of the invention are envisaged.

For example, whilst whereas in the above embodiments the display is a segmented display, in which the segments form the individually addressable image regions, the display may alternatively be in the form of a matrix of pixels, in which the pixels form the individually addressable image regions.

Furthermore, whilst in the above embodiments the electro-optic display is an electrowetting display, other display types are envisaged which may also benefit from the invention.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A method of driving an electro-optic display, the electro-optic display having image regions, each image region being driven by applying a voltage across the image region to select one of:

a first driving state in which a zero voltage, which zero voltage is substantially equal to zero, is applied across the image region; and a second driving state in which a non-zero voltage, which non-zero voltage is substantially different from said zero voltage, is applied across the image region, the non-zero voltage being one of a plurality of non-zero voltages having the same polarity, the method comprising:

applying a common voltage signal to a plurality of said image regions;

applying an actuating voltage signal to one or more selected ones of said plurality of image regions, the voltage applied across the image region being a difference between the common voltage signal and the actuating voltage signal; and varying both said common voltage signal and said actuating voltage signal when switching said selected image regions between said first driving state and said second driving state.

2. A method according to claim 1, wherein a variation of said common voltage signal and a variation of said actuating voltage signal have opposite polarities when conducting said switching.

3. A method according to claim 1, wherein said method comprises varying both said common voltage signal and said actuating voltage signal by an amount greater in magnitude than a quarter of said non-zero voltage when conducting said switching.

4. A method according to claim 3, wherein said method comprises varying said common voltage signal by approximately half of said non-zero voltage, and varying said actuating voltage signal by approximately half of said non-zero voltage, when conducting said switching.

5. A method according to claim 1, the method comprising applying a non-actuating voltage signal to one or more non-selected ones of said plurality of image regions, the voltage applied across the image region being a difference between the common voltage signal and the non-actuating voltage signal, and the non-actuating voltage signal being varied substantially in correspondence with said common voltage signal when conducting said switching.

6. A method according to claim 5, wherein said electro-optic display is a segmented display in which each of said image regions corresponds with a different segment of the electro-optic display, said selected image regions being selected segments, wherein said method comprises applying said common voltage signal and said actuating voltage signal to each of said selected segments simultaneously.

7. A method according to claim 5, wherein said electro-optic display is an electrowetting display which comprises at least one first fluid and a second fluid immiscible with each other, each of said image regions comprising at least one surface area, said at least one first fluid being conductive or polar, wherein in said first driving state said second fluid tends to cover said at least one surface area, and in said second driving state said at least one first fluid tends to cover said at least one surface area, the method comprising applying said common voltage signal to said at least one first fluid.

8. A method according to claim 5 wherein said method comprises varying said common voltage signal by approximately half of said non-zero voltage, and varying said actuating voltage signal by approximately half of said non-zero voltage, when conducting said switching.

9. A method according to claim 1, wherein said electro-optic display is a segmented display in which each of said image regions corresponds with a different segment of the electro-optic display, said selected image regions being selected segments, wherein said method comprises applying said common voltage signal and said actuating voltage signal to each of said selected segments simultaneously.

10. A method according to claim 1, wherein said electro-optic display is an electrowetting display which comprises at least one first fluid and a second fluid immiscible with each other, each of said image regions comprising at least one surface area, said at least one first fluid being conductive or polar, wherein in said first driving state said second fluid tends to cover said at least one surface area, and in said second driving state said at least one first fluid tends to cover said at least one surface area, the method comprising applying said common voltage signal to said at least one first fluid.

11. A method according to claim 10, wherein a plurality of said image regions are fluidly interconnected and arranged such that said at least one first fluid is capable of conveying said common voltage signal to each of said plurality of interconnected image regions.

12. A method according to claim 1, wherein said method comprises varying said common voltage signal and said actuating voltage signal by unequal proportions of said non-zero voltage, said unequal proportions being approximately equal in total to said non-zero voltage, when conducting said switching.

13. Electro-optic display apparatus, the electro-optic display apparatus having image regions, each image region being driven by applying a voltage across the image region to select one of:

a first driving state in which a zero voltage, which zero voltage is substantially equal to zero, is applied across the image region; and a second driving state in which a non-zero voltage, which non-zero voltage is substantially different from said zero voltage, is applied across the image region, the non-zero voltage being one of a plurality of non-zero voltages having the same polarity, the electro-optic display apparatus comprising driving circuitry adapted to:

apply a common voltage signal to a plurality of said image regions;

apply an actuating voltage signal to one or more selected ones of said plurality of image regions, the voltage applied across the image region being a difference between the common voltage signal and the actuating voltage signal; and vary both said common voltage signal and said actuating voltage signal when switching said selected image regions between said first driving state and said second driving state.

14. Electro-optic display apparatus according to claim 13, wherein said driving circuitry is adapted to apply a variation of said common voltage signal and a variation of said actuating voltage signal having opposite polarities when conducting said switching.

15. Electro-optic display apparatus according to claim 13, wherein said driving circuitry is adapted to vary both said common voltage signal and said actuating voltage signal by an amount greater in magnitude than a quarter of said non-zero voltage when conducting said switching.

16. Electro-optic display apparatus according to claim 15, wherein said driving circuitry is adapted to vary said common voltage signal by approximately half of said non-zero voltage, and to vary said actuating voltage signal by approximately half of said non-zero voltage, when conducting said switching.

17. Electro-optic display apparatus according to claim 15, wherein said driving circuitry is adapted to vary said common voltage signal by approximately half of said non-zero voltage, and to vary said actuating voltage signal by approximately half of said non-zero voltage, when conducting said switching.

18. Electro-optic display apparatus according to claim 13, wherein said driving circuitry is adapted to apply a non-actuating voltage signal to one or more non-selected ones of said plurality of image regions, the non-actuating voltage signal being varied substantially in correspondence with said common voltage signal when conducting said switching.

19. Electro-optic display apparatus according to claim 13, wherein said electro-optic display apparatus is an electrowetting display which comprises at least one first fluid and a second fluid immiscible with each other, each of said image regions comprising at least one surface area, said at least one first fluid being conductive or polar, wherein in said first driving state said second fluid tends to cover said at least one surface area, and in said second driving state said at least one first fluid tends to cover said at least one surface area, wherein said driving circuitry is adapted to apply said common voltage signal to said at least one first fluid.

20. Electro-optic display apparatus according to claim 19, wherein a plurality of said image regions are fluidly interconnected and arranged such that said at least one first fluid is capable of conveying said common voltage signal to each of said plurality of interconnected image regions.

21. Electro-optic display apparatus according to claim 13, wherein said electro-optic display apparatus is a segmented display in which each of said image regions corresponds with a different segment of the electro-optic display apparatus, said selected image regions being selected segments, wherein said driving circuitry is adapted to apply said common voltage signal and said actuating voltage signal to each of said selected segments simultaneously.

22. Electro-optic display apparatus according to claim 13, wherein said driving circuitry is adapted to vary said common voltage signal and said actuating voltage signal by unequal proportions of said non-zero voltage, said unequal proportions being approximately equal in total to said non-zero voltage, when conducting said switching.

23. Electro-optic display apparatus according to claim 13, wherein said electro-optic display apparatus is a segmented display in which each of said image regions corresponds with a different segment of the electro-optic display apparatus, said selected image regions being selected segments, wherein said driving circuitry is adapted to apply said common voltage signal and said actuating voltage signal to each of said selected segments simultaneously.

* * * * *